US006378447B1

(12) United States Patent
Martin et al.

(10) Patent No.: US 6,378,447 B1
(45) Date of Patent: Apr. 30, 2002

(54) FURNACE WITH LIQUID-COOLED GRATE ELEMENTS AND COOLING CIRCUIT

(75) Inventors: Johannes Martin, München; Henner-Siegbert Schloms, Egenhofen, both of (DE)

(73) Assignee: Martin GmbH fuer Umwelt- und Energietechnik, Munich (DE)

( * ) Notice: Subject to any disclaimer, the term of this patent is extended or adjusted under 35 U.S.C. 154(b) by 0 days.

(21) Appl. No.: 09/605,950

(22) Filed: Jun. 28, 2000

(30) Foreign Application Priority Data

Jun. 28, 1999 (DE) ..... 199 29 614

(51) Int. Cl.[7] ..... F23H 13/08

(52) U.S. Cl. ..... 110/328; 110/327; 137/564; 126/174

(58) Field of Search ..... 110/327, 328; 137/564, 247.41, 247.11; 73/747, 749, 750, 709; 126/174

(56) References Cited

U.S. PATENT DOCUMENTS

| | | | | | |
|---|---|---|---|---|---|
| 343,069 | A | * | 6/1886 | Rosewater | 137/136 |
| 622,761 | A | * | 4/1899 | Densmore | 73/747 |
| 3,492,871 | A | * | 2/1970 | Rainero | 73/401 |
| 5,159,724 | A | * | 11/1992 | Vosper | 4/679 |
| 5,636,581 | A | * | 6/1997 | Kleen et al. | 110/270 |
| 5,724,898 | A | * | 3/1998 | von Bockh et al. | 110/291 |
| 5,775,238 | A | * | 7/1998 | Hauser | 110/282 |
| 5,899,150 | A | * | 5/1999 | Martin et al. | 110/268 |
| 5,913,274 | A | * | 6/1999 | Kunzli et al. | 110/328 |
| 6,024,031 | A | * | 2/2000 | Stiefel | 110/281 |
| 6,145,451 | A | * | 11/2000 | Zuri et al. | 110/298 |

FOREIGN PATENT DOCUMENTS

| | | |
|---|---|---|
| DE | 624 892 266 | 1/1936 |
| WO | WO 96/29544 | 9/1996 |

* cited by examiner

*Primary Examiner*—Denise L. Ferensic
*Assistant Examiner*—K. B. Rinehart
(74) *Attorney, Agent, or Firm*—Reed Smith LLP

(57) ABSTRACT

The furnace with liquid-cooled grate elements has an inflow and a return to these grate elements, the inflow and the return being connected to a condensation device open to the atmosphere. The inflow has arranged in it a U-shaped cooling-liquid seal, one leg of which has a liquid head which corresponds to an arbitrarily selected maximum pressure. The other, shorter leg is connected to a central distributor for the individual grate elements of the grate stages. The distance between the lowest point of the coolant flow of the lowest grate element and the upper point of the shorter leg corresponds to a selectable safety height amount which generates a pressure which counteracts the spread of steam bubbles occurring in the grate elements, so as to prevent a reversal in the direction of flow of the coolant.

13 Claims, 1 Drawing Sheet

FURNACE WITH LIQUID-COOLED GRATE ELEMENTS AND COOLING CIRCUIT

BACKGROUND OF THE INVENTION a) Field of the Invention

The invention relates to a furnace with liquid-cooled grate elements which each have an inflow and a return for a coolant.

b) Description of the Related Art

Liquid-cooled, in particular water-cooled grate elements for furnace grates have been known for a long time from WO 96/29544 A1 and DE-C-624 892. The first publication discloses the arrangement of a container which is open to the atmosphere, but which allows only a connection of the return to the atmosphere. By contrast, the inflow is fed via a feed pump, with the result that the pressure of the coolant in this region, and also the throughflow quantity, are determined by the work of this feed pump and by the regulating valves located downstream of this pump. The second publication discloses a furnace grate, in which a container open to the atmosphere is provided at the upper end, but this container does not serve as a condensation device, instead making it possible for low-pressure steam to escape into the atmosphere. The amount of cooling of the cooling medium is more or less random in this combustion grate, since the volumetric flow of the primary air, which serves as a recooling medium for the cooling liquid, cannot be varied as desired. As is known, the primary air supplied must be governed by what is happening on the grate in terms of combustion and can therefore in no way bring about in the circulation system a defined condensation of steam which has possibly been formed. One disadvantage of relatively modern furnaces is that a comparatively high outlay in regulating terms has to be accepted, in order to ensure, on the one hand, sufficient cooling of the grate elements and, on the other hand, the necessary safety in the event of the action of excessive heat on the grate elements.

OBJECT AND SUMMARY OF THE INVENTION

The primary object of the invention is to provide a furnace with a cooling system for the grate elements, which dispenses with a regulating device and a feed device for the circulation of the coolant and in which, above all, there is no need for any means for maintaining safety against excessive pressure.

Proceeding from a furnace of the type explained in the introduction, this object is achieved, according to the invention, in that the inflow and the return are connected to a condensation device open to the atmosphere, in that the inflow has arranged in it a U-shaped cooling-liquid seal, one leg of which has a liquid head which generates an arbitrarily selected maximum pressure in the system, and in that the other, shorter leg is connected to a central distributor for the individual grate elements.

An especially preferred refinement, which serves particularly for operating reliability, is characterized in that the upper end, connected to the central distributor, of the shorter leg lies below the lowest point of the coolant flow of the lowest grate element by a selected safety height amount.

The condensation device open to the atmosphere ensures that, even when the coolant is evaporated completely, there can be no higher pressure generated in the circulatory cooling system than that predetermined by the freely selectable liquid head of the longer leg of the liquid seal. In practice, at the present time, a liquid head of 4.85 m above the lowest point of the coolant flow in the lowest grate element will be selected, in order to prevent the excess pressure in the cooling system from exceeding 0.5 bar, since this system otherwise comes under the steam boiler decree which has different safety regulations. The distance between the lowest flow level of the lowest grate element and the upper end, connected to the central distributor, of the shorter leg is designated as the safety height amount and indicates that liquid head which generates in the U-shaped liquid seal a pressure intended to counteract a reverse flow in the cooling system, even when, due to the evaporation of the coolant, a high degree of bubble formation occurs in the grate element in the event of locally particularly strong heat radiation striking the latter. In practice, for safety reasons, this safety height amount is selected in such a way that it corresponds to twice the value of the height difference of an inclined furnace grate between the highest and the lowest point of the coolant flow in this furnace grate.

In order to provide uniform pressure differences between each grate element and the associated central distributor and therefore uniform flow conditions in the individual grate elements, according to an advantageous development of the invention there is provision for the central distributor to be arranged below the fluidically parallel-connected grate elements of the grate stages and in the longitudinal direction of the furnace grate with a vertical clearance which is uniform over the length of the entire furnace grate and is smaller than the safety height amount.

For the same reason, too, in a further refinement of the invention, the return has a central collector for the individual fluidically parallel-connected grate elements of the grate stages, which is arranged below the grate elements and in the longitudinal direction of the furnace grate with a vertical clearance which is uniform over the length of the entire furnace grate and is smaller than the safety height amount. The arrangement both of the central distributor and of the central collector with a vertical clearance relative to the furnace grate, which is smaller than the safety height amount, is provided because operational variations make it necessary, under some circumstances, to vary the safety height amount. Even in such a case, it should be ensured that the central collector and the central distributor have a smaller vertical clearance relative to the furnace grate than corresponds to the safety height amount. This central collector and this central distributor are permanently installed and their height can hardly be varied subsequently, which is not true to the same extent of the connection to the shorter leg of the U-shaped cooling-liquid seal, the said connection defining the safety height clearance.

In order to ensure that the flow velocity through all the grate elements is essentially the same and the result is the necessary pressure gradient for a direction of flow from the central distributor via the grate elements to the central collector, according to an advantageous development of the invention there is provision for a restrictor to be installed in each outflow line between the grate element and the central collector.

Since the grate elements receive relatively little cooling liquid, but a particular liquid reservoir is necessary so as always to have sufficient cooling liquid available in the event of excessive evaporation, in a further advantageous refinement of the invention there is provision for the second, short leg of the U-shaped cooling-liquid seal to have an additional storage volume for cooling liquid.

A preferred refinement for implementing a liquid reservoir is characterized, according to the invention, in that the short leg of the U-shaped cooling-liquid seal is designed as a container, into which the longer leg of smaller diameter penetrates and reaches near to the bottom of the short leg, in that the upper closed end reaches to just below the lowest point of the lowest coolant flow of the lowest grate element, and in that a branch to the central distributor emanates below the highest point of the container. Advantageously, at the same time, the cylindrical container is higher than corresponds to the geodetic height of the short leg, that is to say the cylindrical container extends beyond the branch to the central distributor.

So as to return, again, the entire cooling liquid present in the cooling system, in a development of the invention the central collector, starting from its lowest point, is connected via a line to a condensate collecting container. The cooling liquid can be introduced from here into the system again, in that the condensate collecting container is connected to the condensation device via a pump and a line. It is particularly expedient, in this case, that, according to the invention, the line opens with a spray nozzle into the condensation device.

If, in a further refinement of the invention, the condensation container is provided with a cooling device, the condensed cooling medium can then be returned in cooled form into the condensation device. This affords the possibility that, in a development of the invention, the condensation device is designed as a surface condenser with water-cooled cooling bodies and with a connectable wet-condensation means. The connectable wet-condensation means is formed, in this case, by the spray nozzle, by means of which cooled condensate is sprayed out of the condensate collecting container. This wet-condensation means, in which the steam returned to the condensation device condenses on the cooled water droplets, to some extent still ensures the circulation of cooling liquid even if the water-cooled tubes of the condensation device were to experience a fault.

If, in a further advantageous refinement of the invention, the condensation device is capable of being shut off relative to the atmosphere and of being connected to a vacuum source, the cooling system of the furnace can be put into operation in a particularly simple way as a result. In this case, due to the fall in pressure in the steam space of the condensation device, the same vacuum is generated in the central collector, with the result that the coolant flows out of the grate elements to the central collector according to the fall in pressure, this start of flow also being assisted in that so-called starting burners, which cause heat radiation to strike the furnace grate, are ignited in the furnace space above the furnace grate. The cooling medium located in the grate elements is thereby heated and, where appropriate, even evaporated, with the result that the cooling system is set in motion in the manner of gravity heating.

The invention is explained in more detail below with reference to an exemplary embodiment illustrated in the drawing.

BRIEF DESCRIPTION OF THE DRAWINGS

The single FIGURE illustrates diagrammatically a furnace with a furnace grate and a cooling system.

DESCRIPTION OF THE PREFERRED EMBODIMENTS

Figure 1:
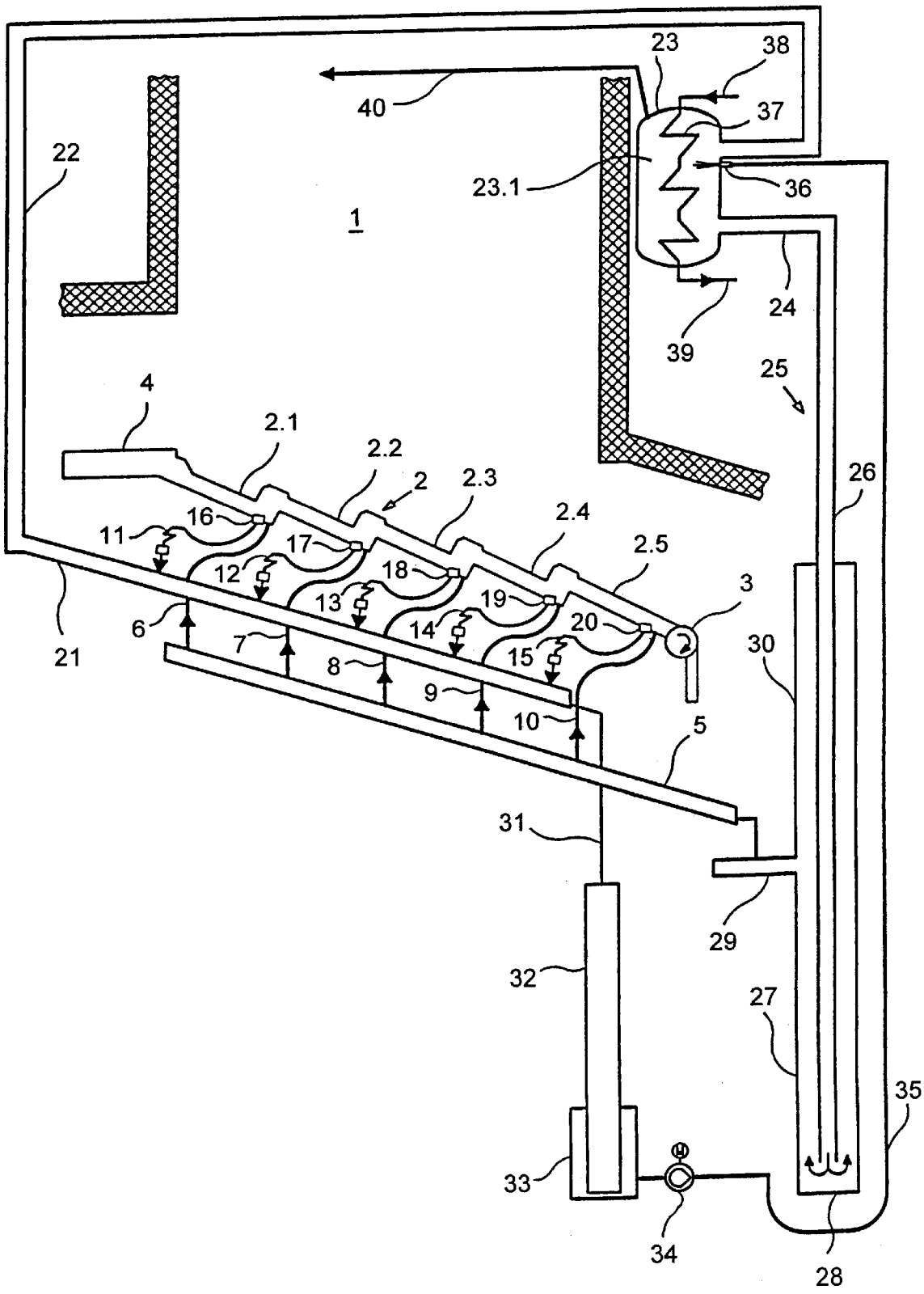

Arranged in a furnace space, designated as a whole by 1, is a furnace grate 2 which has five grate stages 2.1, 2.2, 2.3, 2.4 and 2.5 which are located one behind the other, are composed of grate elements lying next to one another, and overlap in the manner of roof tiles and are inclined so that the rear end of the furnace grate, on which a discharge roller 3 is arranged, is lower than the feed point 4 for the fuel. The individual grate stages 2.1 to 2.5 are water-cooled. For this purpose, these individual grate stages are connected via supply lines 6 to 10 to a central distributor 5 serving as an inflow. Via these lines, cooling liquid, usually water, is supplied to the individual grate stages, whereupon return takes place via outflow lines 11 to 15 which each have a restrictor 16 to 20, in order to build up a system excess pressure in the central distributor 5 and in the individual grate elements to be cooled. The outflow lines 11 to 15 open into a central collector 21 which serves as a return and from which a line 22 leads to a condensation device 23. The condensate occurring in the condensation device 23 flows via an inflow 24 to a cooling-liquid seal, designated by 25, which is designed as a U-tube and of which 26 designates the longer leg and 27 the shorter leg which serves as a liquid reservoir and has a substantially larger diameter than the longer leg 26 of smaller diameter which penetrates into this shorter leg, serving at the same time as a container for storage liquid, and at the same time reaches to just above the bottom 28 of the latter. A connecting line 29 to the central distributor 5 forms the upper end of the shorter leg 27 of this U-shaped cooling-liquid seal 25. For reasons to be set out in more detail, the shorter leg, which at the same time also forms a container 27, is prolonged upwards beyond the connection point of the connecting line 29. This part of the container 27 is designated by 30.

Both the central distributor 5 and the central collector 21 are arranged below the furnace grate 2 and have the same inclination as the furnace grate, so that the respective grate elements are subjected to the same pressure.

A condensate line 31 starts from the lowest point of the central collector 21 and leads to a condensate collecting container 32 which is equipped at its lower end with a cooling device 33. Starting from the lower end of the condensate collecting container 32, the condensate is pumped by means of a pump 34, via a line 35, to the condensation device 23, where it is sprayed into the condensation device 23 via a spray nozzle 36. 37 indicates diagrammatically the condensation device cooling tubes through which a coolant flows and of which the inflow is designated by 38 and the outflow by 39.

Functioning is as follows:

When the furnace is commissioned, the cooling system, that is to say the individual grate elements through which the coolant flows, the central distributor 5, the cooling-liquid seal 25 and the condensation device 23, is filled up somewhat above the connecting line 24. In this state, a hydraulic equilibrium prevails in the cooling circuit. The condensation device 23, which is open to the atmosphere during normal operation, is then briefly closed and is connected to a vacuum source via a line 40. As a result, the upper steam space 23.1 not filled up with liquid is under some vacuum. When the starting burner is then ignited in the furnace space, still no fuel lying on the furnace grate 2, heat radiation strikes the furnace grate. Heat is supplied to the furnace grate and therefore to the coolant present in the grate elements, until the transition from the liquid to the saturated steam phase takes place at a temperature of 96.72° C., when the cooling system is filled with water. The coolant begins to evaporate, and the saturated steam which occurs is conducted via the central collector 21 and the collecting line 22 to the condensation device 23 which is then already open to the atmosphere. The saturated steam condenses here on the cooling tubes 37. Due to the density difference between the liquid in the coolant seal 25 and the saturated steam in the central collector and the steam space 23.1 of the condensation device 23, the coolant is set in circulation. The condensate, intercepted in the condensate collecting container 32, from the central collector 21 is cooled by the cooling device 33 and is sprayed into the steam space 23.1 of the condensation device 23 by means of the pump 34 via the line 35. This spraying in of cooled condensate acts as co-condensation, in which the steam condenses on the cold condensate droplets and which can thus cut in surface condensation.

Moreover, as a result, the condensate occurring in the central collector 21 is supplied to the circuit again.

The cooling-liquid seal 25 is dimensioned in such a way that it has a longer and a shorter leg of a U-tube, the distance of the uppermost point of the longer leg, which is formed by the liquid level in the condensation device 23, above the lowermost point of the coolant flow of the lowest grate element 2.5*s* amount to 4.85 m, so as not to generate any pressure in the system higher than 0.5 bar, otherwise the furnace would come under the steam boiler decree and its design would then become more complicated again. The height difference between the lowest point of the coolant flow in the lowest grate element 2.5 and the upper end of the shorter leg, this end being formed by the connecting line 29, corresponds to a safety height amount which is preferably selected in such a way that it corresponds approximately to double the height difference between the highest coolant flow point of the uppermost grate element and the lowest coolant flow point of the lowermost grate element. This safety height amount yields a head of water and therefore a specific pressure which is sufficient, even in the case of the greatest generation of steam, to counteract the pressure occurring in any of the grate elements in such a way that a reversal of the direction of flow of the coolant stream can never take place. In order to ensure that there is always sufficient liquid coolant, the second, shorter leg must be designed as a container having a thicker diameter than the longer leg, so as not only to be capable of receiving the thinner leg for the formation of a U-shaped tube system, but also to form a particular liquid reservoir, this purpose being served, in particular, by that part 30 of the container 27 which projects upwards beyond the connecting line 29. Since the condensation device 23 is open to the atmosphere during normal operation, a higher pressure cannot be generated in the cooling system than that predetermined by the head of water of the longer leg above the lowest point of the coolant flow of the lowermost grate element. This head, which is freely selectable, determines the maximum pressure in the system, whilst the distance between the lowest coolant flow of the lowest grate element and the connecting line 29, that is to say the upper point of the shorter leg, generates that liquid pressure counter to which steam bubbles occurring in the grate elements would have to act and overcome it, in order to make it possible to bring about a reversal of the coolant flow. On account of the selectability of this safety height amount, the counter pressure can be set so high that, even in the case of the greatest expected action of heat on a grate element, such a steam volume with a corresponding pressure cannot occur.

While the foregoing description and drawings represent the present invention, it will be obvious to those skilled in the art that various changes may be made therein without departing from the true spirit and scope of the present invention.

What is claimed is:

1. A furnace with fluidically connected liquid-cooled grate elements of grate stages wherein each element has an inflow and a return for a coolant, comprising:

a condensation device open to the atmosphere to which said inflow and return are connected;

said inflow having arranged in the inflow a U-shaped cooling-liquid seal;

said seal having one longer leg having a liquid head which generates an arbitrarily selected maximum pressure in the furnace system;

said seal having another shorter leg connected with a central distributor for the individual grate elements;

wherein a central collector is connected to a condensate collecting container via a line;

and wherein the condensate collecting container is connected to the condensation device via a pump and a line.

2. The furnace according to claim 1, wherein an upper end, connected to the central distributor, of the shorter leg lies below a lowest point of the coolant flow of a lowest grate element by a selected safety height amount.

3. The furnace according to claim 1, wherein the central distributor is arranged below fluidically parallel-connected grate elements of the grate stages with a vertical clearance which is uniform in the longitudinal direction of a furnace grate over the length of the entire furnace grate and is smaller than a selected safety height amount.

4. The furnace according to claim 1, wherein said central collector for the individual fluidically parallel-connected liquid cooled grate elements of the grate stages is arranged below the grate elements and in the longitudinal direction of a furnace grate with a vertical clearance which is uniform over the length of the entire furnace grate and is smaller than a selected safety height amount.

5. The furnace according to claim 1, wherein a restrictor is installed in each return line below the grate element and a central collector.

6. The furnace according to claim 1, wherein the second, short leg of the U-shaped cooling-liquid seal has an additional storage volume for cooling liquid.

7. The furnace according to claim 6, wherein the short leg of the U-shaped cooling-liquid seal is designed as a cylindrical container, into which the longer leg of smaller diameter penetrates and reaches near to the bottom of the shorter leg, wherein an upper closed end of the cylindrical container reaches to just below a lowest point of a lowest of the inflow and return coolant flow of the lowest grate element, and wherein a branch to the central distributor emanates below a highest point of the cylindrical container.

8. The furnace according to claim 1, wherein the central collector, starting from the lowest point of the central collector, is connected to a condensate collecting container via a line.

9. The furnace according to claim 8, wherein the condensate collecting container is connected to the condensation device via a pump and a line.

10. The furnace according to claim 8, wherein the line connecting the condensation device to the condensation collector container opens with a spray nozzle into the condensation device.

11. The furnace according to claim 8, wherein the condensate collecting container is provided with a cooling device.

12. The furnace according to claim 1, wherein the central collector, starting from a lowest point of the central collector, is connected to said condensate collecting container via a line.

13. Furnace installation with liquid-cooled grate elements, each having a feed and a return, comprising a U-shaped coolant arrangement whose longer side is connected with a condensation arrangement which is open to the atmosphere and has a liquid level generating an arbitrarily selected maximum pressure in the system, and whose shorter leg is connected with a central distributor to which the individual grate elements are connected via lines and which serves as a feed for the grate elements, and a central collector to which the grate elements are connected via lines and which serves as a return for the grate elements, and a return line which connects the central collector to the condensation arrangement.

* * * * *